US005389421A

United States Patent [19]

Pearlman

[11] Patent Number: 5,389,421

[45] Date of Patent: Feb. 14, 1995

[54] FRINGED WILTON-TYPE CARPET AND METHOD OF MAKING THE SAME

[76] Inventor: Philip Pearlman, 207 Richard Dr., Broomall, Pa. 19008

[21] Appl. No.: 996,337

[22] Filed: Dec. 23, 1992

[51] Int. Cl.[6] ..... B32B 3/02; B32B 3/06

[52] U.S. Cl. ..... 428/82; 428/88; 428/92; 428/102; 428/115; 112/409; 112/410; 139/385

[58] Field of Search ..... 428/82, 88, 92, 102, 428/115; 112/409, 410; 139/385

[56] References Cited

U.S. PATENT DOCUMENTS

| | | | |
|---|---|---|---|
| 1,310,902 | 7/1919 | Ayres | 139/385 |
| 1,394,869 | 10/1921 | Stroud, Jr. | 139/385 |
| 1,825,635 | 9/1931 | Myers | 112/409 |
| 2,001,381 | 5/1935 | Davison | 428/88 |
| 3,425,891 | 2/1969 | Tanner et al. | 428/115 |

*Primary Examiner*—George F. Lesmes
*Assistant Examiner*—Terrel Morris
*Attorney, Agent, or Firm*—Caesar, Rivise, Bernstein, Cohen & Pokotilow, Ltd.

[57] ABSTRACT

A Wilton-type carpet and methods of making integral fringes on it, of affixing a decorative border around the periphery of the carpet and of inlaying decorative strands within the design of the carpet. The method creates integral fringes by the one way looming of the face yarns and by the severance of two transverse backing strands. The backing is undone while simultaneously releasing face yarns to act as the fringes. The method also provides a shelf at the fringe/carpet face interface allowing for a decorative trim to be affixed thereto. Another aspect of the method entails the complete removal of face yarns at both left and right sides to result in a shelf along the left and right sides to which decorative trim can be affixed. The face yarns within the carpet face can be removed in both the longitudinal and transverse directions to inlay decorative yarn therein.

8 Claims, 4 Drawing Sheets

FIG. 3
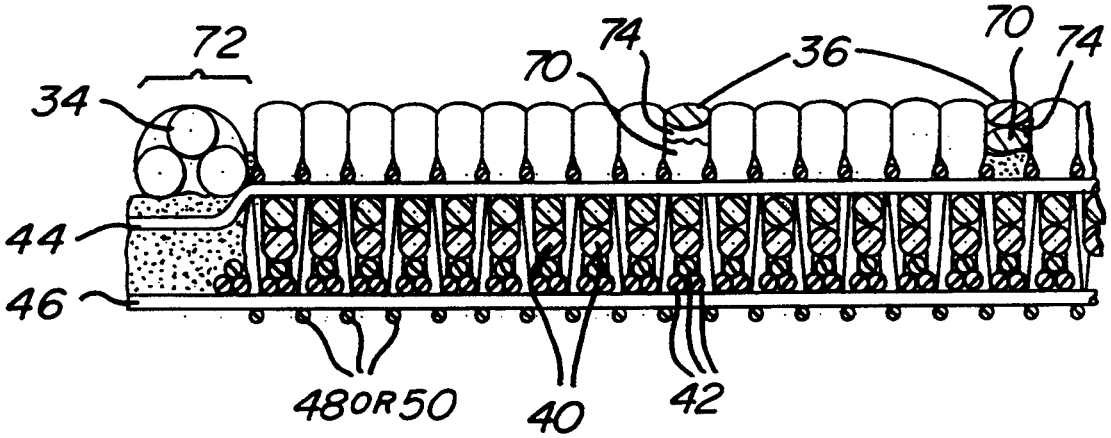
FIG. 4
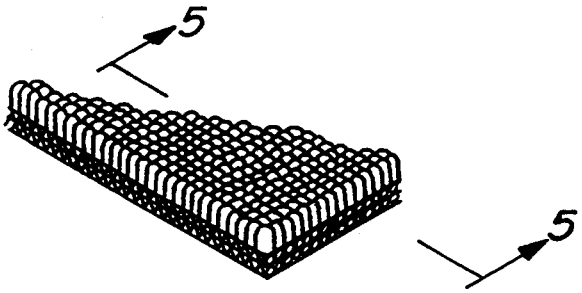
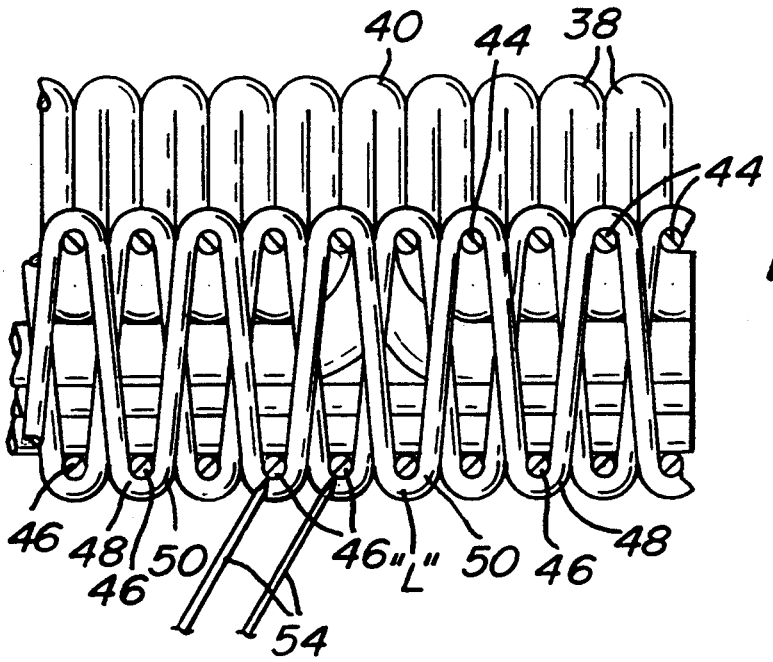
FIG. 5

FRINGED WILTON-TYPE CARPET AND METHOD OF MAKING THE SAME

BACKGROUND OF THE INVENTION

This invention relates generally to woven carpets and, more particularly to the fringing, decorative bordering and the inlaying of independent strands into the face design of Wilton carpets.

The Wilton carpet is one type of woven carpet, where the face yarn is woven into the backing material, not just fastened to the backing with adhesive as are tufted carpets. The Wilton carpet, named for the town in England where this type of carpet looming originated, is distinguished by the layering of its face yarns: the Wilton loom uses up to as many as six different yarns to form the pile—the design in the carpet face. Although it varies from carpet to carpet, one face yarn is the dominant yarn whose loops form the majority of the carpet design. Where the design requires a yarn of a different color or texture, that yarn forms a loop in the design. Otherwise, this least-used strand remains buried beneath the dominant yarn, running in a parallel direction through the carpet backing. The face yarn and all its underlying yarns are woven in one direction: the longitudinal direction. There are no yarns woven in the transverse direction.

Usually, the Wilton carpet border is finished off with a binding—a fabric sewn around the periphery of the carpet. This binding hides the cut ends of the face yarns and backing strands and also serves to keep these yarns and strands from fraying and unraveling. However, the binding detracts from the overall appearance of the carpet due to its "non-integral" nature. This can be further aggravated by the visibility of any stitching used to affix the binding to the carpet.

For clarity of fiber orientation, strands running in the direction of loom motion, i.e., the longitudinal direction, are known as warp strands. Strands running perpendicular to the loom motion, i.e., the transverse direction, are known as weft strands.

The following constitute examples of various types of prior art involving woven carpets in general concerning fringing and the inlaying of independent yarns into the carpet design as found in the following U.S. Pat. Nos. 647,100 (Kross); 1,310,902 (Ayres); 1,899,219 (Underwood); 2,141,386 (Habib); 3,279,026 (Strauss et al.); 3,727,645 (Jowett); 5,027,483 (Anderson).

The method disclosed by Kross requires narrow strips of used woven fabric be fed into an apparatus that cuts the warp threads on each edge of the fabric strip at short intervals. After the fabric is removed from the machine and the cut warp strands are shaken out, the result is a fabric strip with fringes along the longitudinal sides of the strip. These fringes, consisting of weft fibers, are then woven into an article to be fringed.

The method disclosed by Ayres is to create integral fringing from the weft strands rather than from the warp strands. The result of the Ayres' method is that the width of the fabric as woven becomes the length of the carpet and instead of the warp strands being the longer threads of such carpet, the weft fibers are the longer. In the production of the woven fabric, just within the longitudinal sides of the fabric, there is a band of fabric where warp strands are highly dispersed. Everywhere else, at the very edge of the longitudinal sides and outside the band, both weft and warp strands occur in their usual density. Upon removal of the fabric, the dispersed warp strands in the band are removed and a plurality of weft strands are twisted with each other within the band. These twists are then glued or latexed to permanently maintain the twisting. Following this, the longitudinal sides of the fabric are cut off, leaving a woven fabric with fringes on the sides perpendicular to the loom motion.

The method disclosed by Underwood creates fringes, independent of the carpet itself, which are then attached to the border of the carpet which is to have fringing, i.e., the entire fabric consists of multiple fringe segments that can be cut from the fabric and applied to another carpet. A fringe segment consists of a body to which the fringes are attached. Once the fabric is woven, it largely consists of weft strands. These strands will form the fringes for every fringe segment. Uniformly dispersed along the weft strands are two perpendicular and adjacent bands of woven weft and warp strands. These two bands (pair) are separated from one another by small lengths of weft strands. The pair will form the body of the fringe segment. Starting from one end of the fabric, and midway between the first two pairs, the weft strands are cut. What has been removed is a fringe segment. The fringe segment is folded over such that the two bands are on top of one another. This folded-over segment is the body of the fringe segment and is then sewn onto the border of the carpet which is to have fringing.

The method disclosed by Habib is similar to that disclosed by Ayres in creating the fringes of a woven fabric. Under the Habib teaching, the weft strands are also used for the fringes rather than the warp strands. However, in creating the longitudinal bands, no warp strands are used. Once the fabric is removed from the loom, the longitudinal edges need only be cut and the result is the same as taught by Ayres.

Strauss et al. discloses an apparatus for mechanically fraying and fringing the edge of a straight cut fabric of desired width of edge and to a desired depth or length of fringe. The apparatus uses a spindle to release a transverse yarn fiber. Depending on how far into the spindle the woven fabric is fed, determines the number of transverse yarn fibers released and thereby establishes the length of the fringes (i.e., the yarn fibers along the spindle axis from which the transverse yarns are released, form the fringes).

Jowett discloses a modification to a Wilton carpet loom which creates a passage across the width of the loom for insertion of pile wires (face yarn). The loom uses a movable guide to permit the insertion of a desired strand within the face of the fabric and then returns the loom to the mode it was in just before the insertion occurred. This apparatus permits the insertion of an independent fiber during the carpet's original production.

The method disclosed by Anderson is for selectively releasing tied yarns from a fringe strip, separating them and then presenting them for interweaving in a seam area. This method does not result in the creation of a fringe projecting from the edge of a carpet.

Based on this prior art, carpet fringes along the sides of the carpet have been created by manipulating the weft strands into fringes. To accomplish this, the looming had to be contrived so that free weft strands could be available upon the carpet's removal from the loom. This required the use of edge bands of woven warp and weft fibers to hold the carpet together during looming.

Upon the carpet's removal from the loom and once the unwoven weft fibers were twisted and glued in such a manner as to not come apart, these edge bands were cut off and disposed of, leaving free weft fibers to act as fringes. Such "integral" fringing utilized the weft strands of the loomed carpet itself to act as fringes. Both Ayres and Habib teach such an integral weft strand method of creating a fringe. On the other hand, Underwood teaches the looming of "non-integral" or independent fringes which are then attached to the desired carpet to be fringed.

As the prior art stands, no method exists for creating fringing at the two ends of a Wilton carpet using integral fringes by way of the warp strands. The prior art has not provided for a Wilton carpet with integral fringe, nor a viable method of producing a fringed Wilton carpet. Thus, a need exists for the same.

OBJECTS OF THE INVENTION

It is a general object of this invention to create fringes at the longitudinal ends of a Wilton carpet.

It is another object of this invention to provide a Wilton carpet with integral fringing.

It is still another object to provide a fringed Wilton carpet with finished edges in order to eliminate the typical binding applied around the carpet periphery.

It is still another object to provide a Wilton carpet with independently inlaid strands in the face yarns.

It is yet another object to provide a method of fringing a Wilton carpet which can be performed by one person with ordinary tools.

It is yet another object to provide a method of producing integral fringing on a Wilton carpet.

It is yet another object to provide a method of inlaying decorative material in the pile of Wilton carpeting.

SUMMARY OF THE INVENTION

These and other objects of the invention are achieved by providing a method for creating integral fringing of a Wilton carpet at its longitudinal ends.

In accordance with one aspect of this invention, strips of material (e.g., braids, decorative material, etc.) are affixed (e.g., by way of glue, latex or any other adhesive or by way of sewing or any combination of these) to the longitudinal ends of the Wilton carpet where the integral fringes originate.

In accordance with another aspect of this invention, strips of material (e.g., braids, decorative material, etc.) are affixed (e.g., by way of glue, latex or any other adhesive or by way of sewing or any combination of these) to the left and right sides of the Wilton carpet.

In accordance with another aspect of this invention, totally different strands of material can be inlayed following the removal of at least one column of face yarn, from one end of the Wilton carpet to the other end in order to also enhance the design. Or such an inlay can be any length just short of the length from one end of the carpet to the other end.

In accordance with yet another aspect of this invention, totally different strands of material can be inlayed following the removal of at least one row of face yarn to enhance the design. Such an inlay can span an entire row, from the left side to the right side of the Wilton carpet. Or such an inlay can be any length just short of the length from the left side to the right side.

DESCRIPTION OF THE DRAWING

FIG. 3 is an enlarged sectional view taken along line 3—3 of FIG. 1;

FIG. 4 is an isometric view of a corner of a conventional Wilton-type carpet without and binding on its edges and ready to be processed in accordance with the method of this invention to produce the carpet shown in FIG. 1;

FIG. 5 is an enlarged sectional view taken along line 5—5 of FIG. 4.

DETAILED DESCRIPTION OF THE PREFERRED EMBODIMENT

For clarity, the longitudinal direction will refer to an orientation from one end (where fringing will occur) to the other end (where fringing will also occur) of the Wilton carpet whereas the transverse direction will refer to an orientation from the left side to the right side of the Wilton carpet.

Figure 1:
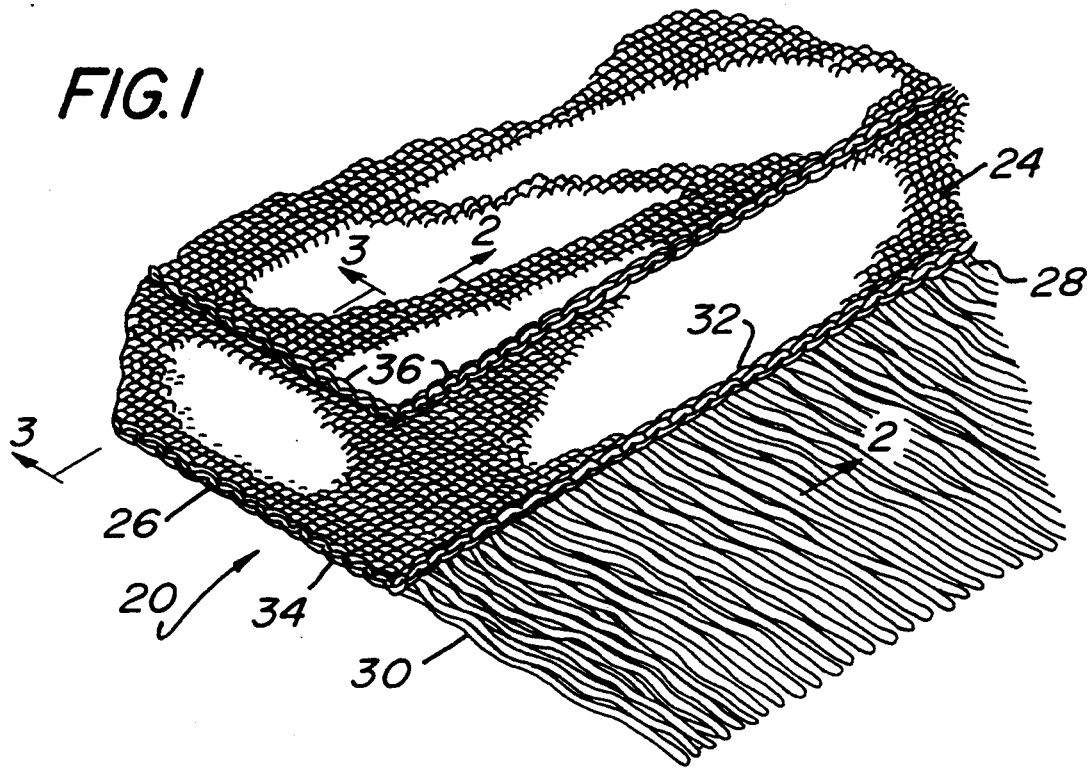
FIG. 1 is an isometric view of one corner portion of Wilton-type carpet constructed in accordance with this invention.

Referring now to the various figures of the drawings wherein like reference numerals refer to like parts, there is shown at 20 in FIG. 1 a Wilton-type carpet constructed in accordance with this invention. The carpet 20 basically comprises a backing layer 22 and a looped yarn facing layer 24 which are of conventional construction. The carpet shown in FIG. 1 is rectangular, but could be of other shapes, and includes a left side 26, a right side (not shown) and a pair of longitudinal ends (only one 28 of which is shown in FIG. 1). Moreover, the carpet shown in FIG. 1 uses only two different face yarns but this method is applicable to Wilton carpets using the maximum number (six) of different face yarns.

In accordance with one aspect of this invention, each of the longitudinal ends is fringed with the yarns making up those fringes 30 (only one side fringing shown) being integral with and extensions of the yarns forming the loops of the facing layer. A strip of material 32 is fixedly secured, as will be described later, along a line forming the interface of the fringes 30 and the end loops (to be described later) of the yarns of the facing along that longitudinal end. A similar strip (not shown) is fixedly secured along a corresponding line forming the interface of the fringes (not shown) and the end loops of the yarns of the facing along the other longitudinal end.

Preferably, a pair of strips of material (only one 34 of which is shown) are fixedly secured to the facing along the left side 26 and right side, respectively.

In accordance with another aspect of this invention, one or more lines of loops of yarns forming the facing are removed and replaced by inlay strips 36 to provide a decorative appearance to the carpet.

The details of the carpet's construction will now be discussed. For clarity, weft strands are oriented from the left side 26 to the right side (not shown) whereas warp strands are oriented from one end 28 to the other end (not shown).

The facing layer 24 consists of plural loops of yarns 38 and 40 of different colors. The least-used face yarn 40 is mostly hidden beneath the dominant face yarn 38.

Both face yarns 38 and 40 are loomed within the backing 22 to form a design, with the least-used face yarn 40 appearing in the facing layer 24 at desired locations.

The backing 22 consists of stuffer strands 42, upper 44 and lower 46 weft strands and alternating warp strands, 48 and 50. The stuffer strands 42 run longitudinally forming the majority of the backing 22 of the Wilton carpet. The warp strands 48 and 50 (see FIG. 5) alternate looping around the upper 44 and lower 46 weft strands, binding the top and bottom of the carpet together. The face yarns 38 and 40 are loomed around the upper weft strands 44, with the least-used face yarn 40 running underneath the dominant face yarn 38.

The fringes 30 are created by the following procedure. An unfringed, conventional Wilton carpet 21 (see FIG. 4) is situated with its backing 22 facing upwards and a transverse line "L" (as shown in FIG. 5) is drawn from the left side 26 to the right side using some marking device along a selected lower weft strand 46, at a specific distance from one carpet end 29 (see FIG. 4). This distance determines the length of the fringes 30. Just beyond (outward of) this line "L" a ¼" band of latex 52 (FIG. 7) is applied to the backing 22 from the left side 26 to the right side of the carpet and allowed to dry. Then, just inside the line "L", two adjacent lower weft strands 46 are selected and cutting blades 54 are drawn along the length of each of those selected lower weft strands 46, from the left side 26 to the right side of the carpet to sever every warp strand 48 and 50 that is looped around these two adjacent weft strands 46. This severance of all warp strands 48 and 50 releases both the upper 44 and lower 46 weft strands, from the left side 26 down to the right side of the carpet, from the transverse line "L" outward to carpet end 29.

Figure 6:
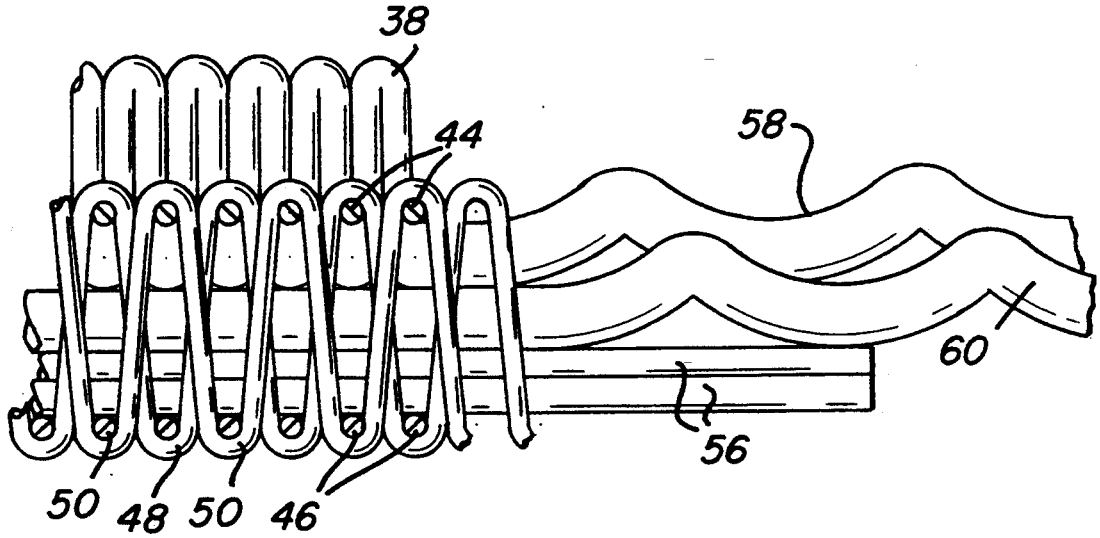
FIGS. 6–9 are views similar to that of FIG. 5 but showing sequential steps in the formation of the Wilton-type carpet shown in FIG. 1.
Figure 7:
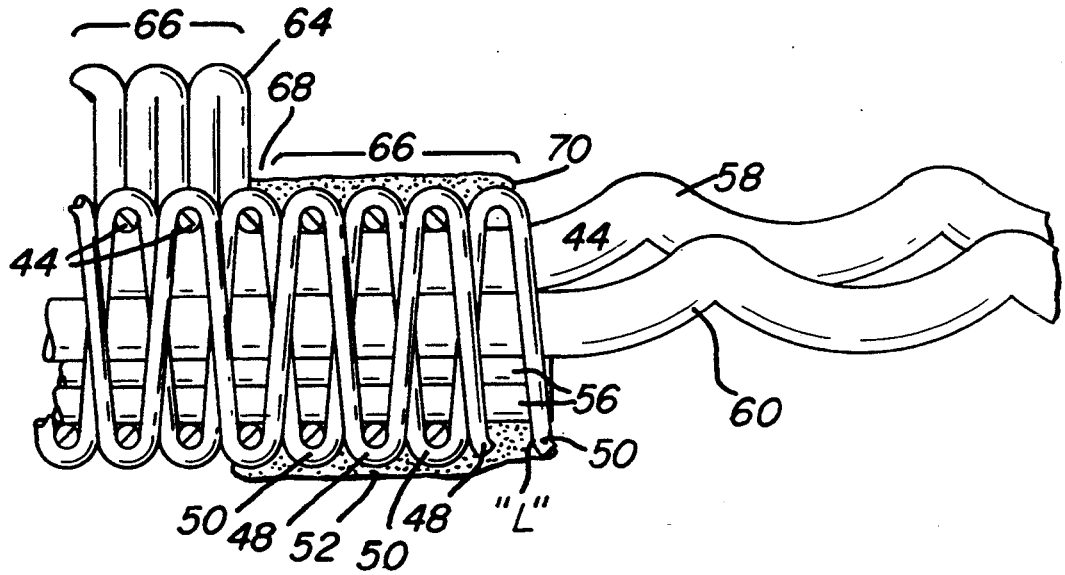

At this point, starting with the two adjacent lower weft strands 46 along which the cutting blades 54 were drawn, every lower weft strand 46 from those two strands to the carpet end 29 are manually removed from the backing 22. As this is done, the alternating warp strands 48 and 50 that have been cut should also be removed from between the stuffer strands 42 and face yarns 38 and 40. The released stuffer strands 56 and released face yarns 58 and 60 are then separated from one another as shown in FIG. 6. The released stuffer strands 56 are then cut off as close as possible to the line "L" as shown in FIG. 7. The carpet is then turned over and any remaining cut weft or warp strands remaining are removed from the released face yarns 58 and 60.

All the released face yarns 58 and 60 are then pulled longitudinally outward away from the new carpet end 28 (FIG. 6 and FIG. 7), thereby removing the loops formed by the face yarns 38 and 40. Care must be taken in pulling each released face yarn 58 and 60 the same distance to eliminate a predetermined number of loops at the end 28 of the carpet because the corresponding face yarns 38 and 40 are not locked into the backing 22 and could easily be pulled out of the carpet entirely. As the released face yarns 58 and 60 are pulled, a "shelf" 62 (FIG. 7) is formed contiguous with the end loop 64 of each face yarn at that location. This shelf 62 consists of the upper weft strands 44 and the warp strands 48 and 50. Each of the face yarns 38 and 40 is pulled a desired distance, e.g., the length of three face yarn loops 66, to create a shelf 62, approximately 0.4 inch (1 cm) wide.

This interface 68 of the shelf 62 with the end loop 64 of each face yarn is in the form of a straight line. An adhesive 70 is applied to the shelf 62 to prevent the released face yarns 58 and 60 from being pulled out any further. Once the adhesive 70 dries, a strip of material 32 (e.g., a braid) of any suitable material (e.g., wool) is then affixed (e.g., glued and/or sewn) on top of the shelf 62 along the entire length of the carpet end 28.

This same fringing procedure is conducted at the other end of the carpet so that the result is a Wilton carpet with loose, integral fringes at both ends and with the interface of the facing layer 24 and the fringes on both ends having a decorative strip (e.g., a braided border).

In accordance with one aspect of this invention, a decorative strip 34 (e.g., a braid) is provided along the left side 26 and right side. In particular, to affix a braid 34 along the left side 26 of the carpet, it is also necessary to create a "shelf". This is accomplished, as shown in FIG. 3, by pulling out entirely one dominant face yarn 38 and its corresponding face yarn 40 along that side 26 of the carpet. Next, the adjacent alternating warp strands 48 and 50 are entirely removed from the carpet. Care must be used to avoid pulling out the stuffer strands 42 from between the upper 44 and lower 46 weft strands. Following this, the procedure is repeated: the adjacent face yarn 38 and its corresponding face yarn 40 are entirely removed from the carpet followed by the removal of the adjacent alternating warp strands 48 and 50. What remains is a shelf 72 with a width of two face yarn strands, consisting of weft strands and stuffer strands. An adhesive or latex 70 is then applied to this shelf 72 and a braid 34 is then affixed to this shelf 72.

Figure 8:
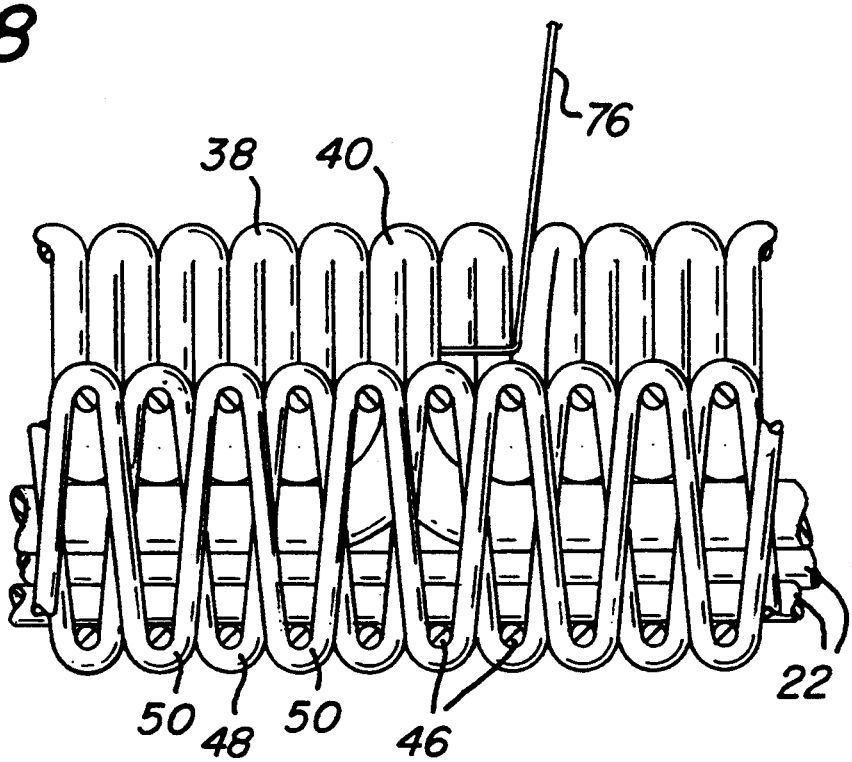
Figure 9:
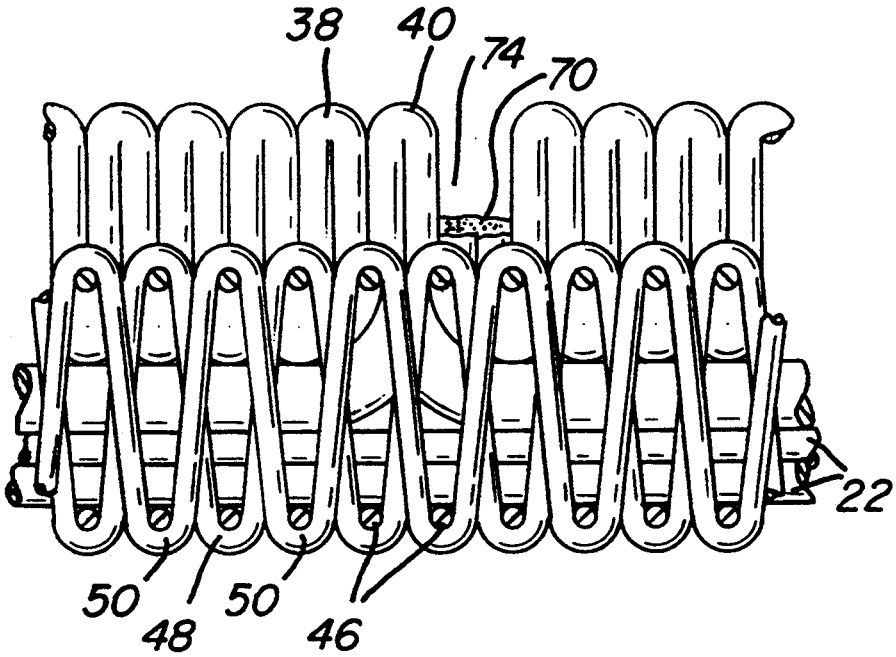

In accordance with another aspect of this invention, a segment of yarn or braid can also be inlayed as shown in FIGS. 3, 8 and 9 following the removal of a face yarn 38 and 40 to enhance the design in either the longitudinal and/or transverse direction of the carpet 20.

To inlay a braid 36, or yarn, in the longitudinal direction, one (usually only a braid of one face yarn width is inserted) face yarn strand 38 (and, if necessary, one face yarn strand 40) is pulled out, as shown in FIG. 3 to form a channel 74. If the longitudinal inlay 36 is to terminate at at least one carpet end 28, the face yarns 38 and 40 can simply be pulled out of the backing 22 up to the point where the inlay braid 36 should begin. An adhesive 70 (FIG. 3) is then applied within the remaining channel 74 and the inlay braid 36 inserted to complete the inlay. If the braid is not to terminate at either carpet end, the carpet can be "grinned", i.e., the left side 26 and right side can be bent to contact one another such that the particular face yarns 38 and 40 in one column are projected up and out of the carpet. Using a pair of carpet shears 76 like those shown in FIG. 8, the particular face yarn loops 38 and 40 in that column are then cut, resulting in a channel 74 as shown in FIG. 3. Again, an adhesive 70 is then applied within the channel 74 and an inlay braid 36 is inlayed in that channel 74.

To inlay a separate braid 36 or yarn in the transverse direction, a similar procedure is used. First, the Wilton carpet 20 is folded in the transverse direction at the row of face yarns 38 and 40 where the inlay 36 is to be affixed. Bending the carpet in such a manner will raise the face yarns 38 and 40 in the row to be removed. Next, using a pair of carpet shears 76 (FIG. 8) the face yarns 38 and 40 in that row are cut in the transverse direction resulting in an exposed channel 74 running across the face of the carpet 20 (FIG. 9). Because a transverse cut severs all face yarns 38 and 40 from the left side 26 to the right side of the carpet 20, an adhesive 70 must be applied within the resulting transverse channel 74 (FIG. 9) to prevent the cut face yarns 38 and 40 from ever being released. A braid can then be affixed (e.g., glued, latexed, sewn, or both) within the channel 74.

Where an braid is affixed to the carpet end 28 of the Wilton carpet 20, triple strands within the braid 36 are utilized. Where a braid 36 is affixed to the left side 26 or right side of the Wilton carpet 20, double strands are utilized. Where a braid is used within the facing layer design, a single strand is utilized. As with any of these braids, the size may vary depending on the desired width of the shelf or channel.

Figure 2:
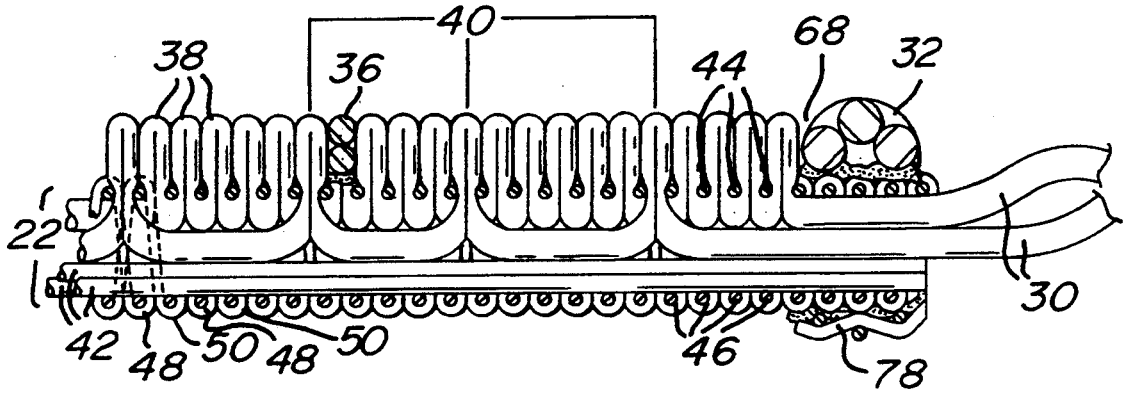
FIG. 2 is an enlarged sectional view taken along line 2—2 of FIG. 1.

As shown in FIG. 2, a backing strip 78 is affixed to the backing 22 at a location just beneath the interface 68 at both ends of the Wilton carpet. This backing strip 78 is a narrow strip of material that runs from the left side 26 to the right side, acting as cover to the interface from the backing 22 side. This strip 78 can be glued and/or sewn or both to the backing 22.

Without further elaboration, the foregoing will so fully illustrate my invention that others may, by applying current or future knowledge, adopt the same for use under various conditions of service.

I claim:

1. A Wilton carpet having a left side, a right side, and a pair of ends, a longitudinal axis, and a transverse axis, said carpet comprising a backing layer and a face layer, said face layer comprising plural loops of a yarn extending in plural longitudinal lines parallel to said longitudinal axis, and with the yarns forming each of said lines of loops terminating in an unlooped yarn portion forming a loose fringe extending beyond said backing layer at each of said pair of ends, each of said longitudinal lines of loops includes an end loop contiguous with a respective one of said fringes, wherein the end loops of each of said lines of loops on one end of said carpet form a first interface line thereat and the end loops of each of said lines of loops on the other end of said carpet form a second interface line thereat, and respective strips of material are secured to said fringes along said first and second interface lines and wherein, each of said strips is braided.

2. The Wilton carpet of claim 1 additionally comprising a braided strip secured to and extending along said left side and a braided strip secured to and extending along said right side.

3. A Wilton carpet having a left side, a right side, and a pair of ends, a longitudinal axis, and a transverse axis, said carpet comprising a backing layer and a face layer, said face layer comprising plural loops of a yarn extending in plural longitudinal lines parallel to said longitudinal axis, and with the yarns forming each of said lines of loops terminating in an unlooped yarn portion forming a loose fringe extending beyond said backing layer at each of said pair of ends, and wherein said face layer includes portions in the form of at least one line in which said loops are removed and replaced by an inlay strip.

4. The Wilton carpet of claim 3 wherein said inlay strip is braided.

5. A Wilton carpet having a left side, a right side, and a pair of ends, a longitudinal axis, and a transverse axis, said carpet comprising a backing layer and a face layer, said face layer comprising plural loops of a yarn extending in plural longitudinal lines parallel to said longitudinal axis, and with the yarns forming each of said lines of loops terminating in an unlooped yarn portion forming a loose fringe extending beyond said backing layer at each of said pair of ends, each of said longitudinal lines of loops includes an end loop contiguous with a respective one of said fringes, wherein the end loops of each of said lines of loops on one end of said carpet form a first interface line thereat and the end loops of each of said lines of loops on the other end of said carpet form a second interface line thereat and wherein said respective strips of material are adhesively secured to said fringes along said first and second interface lines, and are sewn to said fringes and said backing layer along said first and second interface lines, and wherein said face layer includes portions in the form of at least one line in which said loops are removed and replaced by an inlay strip.

6. The Wilton carpet of claim 5 wherein said inlay strip is braided.

7. A Wilton carpet having a left side, a right side, and a pair of ends, a longitudinal axis, and a transverse axis, said carpet comprising a backing layer and a face layer, said face layer comprising plural loops of a yarn extending in plural longitudinal lines parallel to said longitudinal axis, and with the yarns forming each of said lines of loops terminating in an unlooped yarn portion forming a loose fringe extending beyond said backing layer at each of said pair of ends, said carpet additionally comprising a strip secured to and extending along said left side and a strip secured to and extending along said right side, and wherein said face layer includes portions in the form of at least one line in which said loops are removed and replaced by an inlay strip.

8. The Wilton type carpet of claim 7 wherein said inlay strip is braided.

* * * * *